United States Patent [19]

Raab et al.

[11] Patent Number: 4,813,353

[45] Date of Patent: Mar. 21, 1989

[54] CLAMPING SHEET GRIPPER FOR A SHEET-FED ROTARY PRINTING PRESS

[76] Inventors: Rudolf Raab, Innweg 4, 6450 Hanau 7; Manfred Herold, Hanauer Landstr. 54, 8756 Kahl/Main; Peter Hummel, Schlesierstr. 13, 6050 Offenbach/Main, all of Fed. Rep. of Germany

[21] Appl. No.: 101,377

[22] Filed: Sep. 25, 1987

[30] Foreign Application Priority Data

Sep. 26, 1986 [DE] Fed. Rep. of Germany ..... 3632769

[51] Int. Cl.[4] ..... B41F 21/10

[52] U.S. Cl. ..... 101/410; 101/415.1; 271/82; 271/277

[58] Field of Search ..... 101/408, 409, 410, 415.1, 101/142; 271/82, 277, 268

[56] References Cited

U.S. PATENT DOCUMENTS

| | | | |
|---|---|---|---|
| 3,606,308 | 9/1971 | Mowry et al. | 271/277 |
| 3,637,202 | 1/1972 | Mowry et al. | 101/409 X |
| 4,466,350 | 8/1984 | Schilling et al. | 101/410 |
| 4,475,459 | 10/1984 | Naube et al. | 271/82 X |
| 4,583,728 | 4/1986 | Mathes | 271/277 X |
| 4,697,512 | 10/1987 | Simeth | 101/410 X |

FOREIGN PATENT DOCUMENTS

| | | | |
|---|---|---|---|
| 488949 | 1/1930 | Fed. Rep. of Germany | 101/415.1 |
| 974955 | 7/1961 | Fed. Rep. of Germany | 101/415.1 |
| 66634 | 5/1969 | Fed. Rep. of Germany | 101/415.1 |
| 67992 | 7/1969 | Fed. Rep. of Germany | 101/415.1 |
| 1908181 | 11/1970 | Fed. Rep. of Germany | 101/415.1 |
| 2030040 | 1/1976 | Fed. Rep. of Germany | 101/415.1 |
| 3037776 | 7/1981 | Fed. Rep. of Germany | 101/410 |
| 3130689 | 7/1982 | Fed. Rep. of Germany | 101/415.1 |
| 3226619 | 4/1983 | Fed. Rep. of Germany | 101/415.1 |
| 3529639 | 8/1985 | Fed. Rep. of Germany | 101/415.1 |
| 116546 | 6/1986 | Japan | 101/415.1 |
| 765024 | 9/1980 | U.S.S.R. | 101/415.1 |
| 2151213 | 7/1985 | United Kingdom | 101/415.1 |

*Primary Examiner*—Edgar S. Burr
*Assistant Examiner*—James R. McDaniel

[57] ABSTRACT

A sheet gripper for a rotary press is provided having a hooked gripper finger pivotably connected at its lower end to a clamping element, and a roller disposed upon the gripper finger is biased against the guiding surfaces of a finger support element to ensure smooth changes from open and closed gripper finger positions, substantially without any vibrational motion or displacement resulting in the plane of sheet motion. Preferably, a compression spring is mounted in the clamping element to bias the roller against the gripper support element, the element having a rectilinear guide surface disposed substantially perpendicularly to a retaining surface, and a cam surface which extends upwardly and inclined outwardly from the rectilinear guide surface. Upon oscillation of the gripper shaft, the roller is guided along the rectilinear guide surface and cam surface, thereby defining accurate gripper finger motion.

4 Claims, 1 Drawing Sheet

FIG. 1
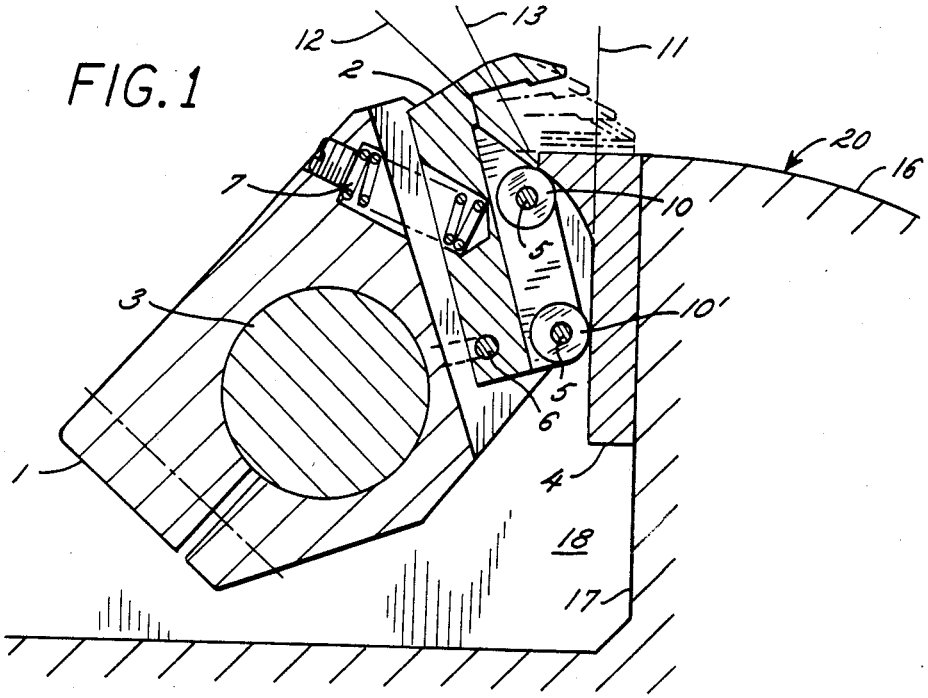
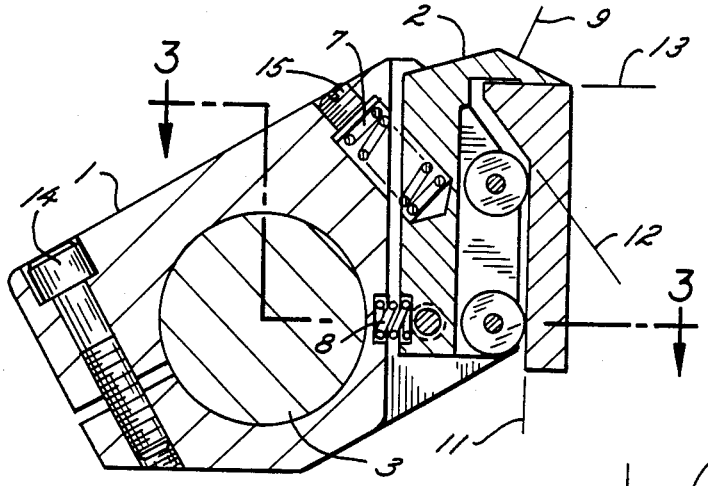
FIG. 2
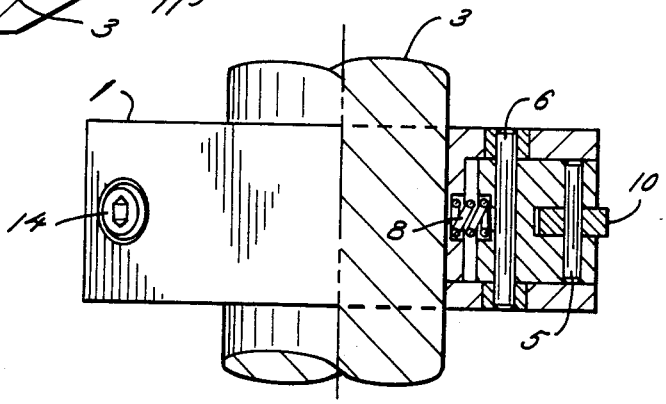
FIG. 3

CLAMPING SHEET GRIPPER FOR A SHEET-FED ROTARY PRINTING PRESS

FIELD OF THE INVENTION

The present invention relates generally to a sheet gripper for a sheet-fed rotary printing press and more particularly concerns such a gripper having a clamping gripper finger.

BACKGROUND OF THE INVENTION

Clamping sheet grippers are widely used in printing presses to grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper systems require very considerable forces for their actuation and only some of such forces can be used for sheet retention. Furthermore, these substantial and abrupt forces may cause unwanted oscillations of the press.

A gripper system of this general kind is shown in DE-PS No. 488 949. A disadvantage of this known system is that the hooked gripper finger is loosely guided between the cylinder wall and guide strip. At high press speeds, only a few milliseconds are available for opening the grippers, and this results in abrupt loads which jar the machine and cause muddy printing. In this gripper, gripper shaft vibrations act both horizontally and perpendicularly to the sheet movement direction, and as a result, cause inaccurate positioning of the delivered sheets.

Another known gripper system is disclosed in DD-PS No. 66 634 wherein a one-piece gripper lever is supported on a gripper shaft and adjustable biasing is provided by two compression springs. A disadvantage of this known system is that the gripper lever loses its statically determined position when the fullest possible compensation for the bearing force is required. At very high press speeds and high biasing forces, centering becomes inadequate, for example, as a result of disturbing vibrations introduced into the press. Other disadvantages are the relatively large inertia radius and the mass of the swinging parts.

DE-OS No. 1 908 181 discloses a gripper system wherein the spindle for the gripper finger pivot is pivotally disposed parallel to the gripper shaft, the spindle of the gripper finger pivot being disposed substantially on the prolongation of a straight line connecting the support surface for the gripper tip to the gripper shaft axis. As is apparent from the geometry shown therein in FIG. 1, the force which the gripper tip applies to the gripper support also has a component in the direction of sheet movement. The sheet may therefore move for this reason and because of possible twisting of the gripper shaft at high biasing, even though there may be some improvement as compared with conventional grippers in which there is an arcuate motion around the gripper shaft axis.

The gripper disclosed in DD-PS No. 67 992 is mounted by means of a clamping member on a pivotable gripper shaft having a stationary axis. A gripper tongue makes a circular movement around such axis in a first movement phase and makes a movement substantially perpendicular to the gripper supporting a second movement phase. This gripper, however, uses a non-positive parallel strip spring arrangement and a gripper tongue which cannot withstand substantial closing forces without buckling. The gripper is therefore completely unsuitable for use with very high closing forces.

Gripper systems of the type disclosed in DE-PS No. 2 030 040 use a perpendicularly closing gripper with a controlled gripper shaft. A disadvantage of this known system is that the non-positive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance.

The gripper system shown in DE-OS No. 3 130 689 uses a soft gripper support along with a gripper finger which has a flat gripper flight path and which closes perpendicularly in the final movement phase. There is a resilient abutment screw disposed in the gripper finger and operative against the sheet gripper stop. An additional adjusting screw is needed to adjust the resiliently interconnected holders by which the gripper finger is associated with the gripper shaft. A disadvantage of this type of gripper is that the gripper finger must be associated with a soft gripper support and complicated adjustments must be made by means of two adjusting screws to ensure accurate operation. Furthermore, the gripping action becomes uncertain at high press speeds.

The gripper system disclosed in patent application No. P 35 29 639.9-27 uses a resilient clamping gripper which, irrespective of the presence of a soft gripper support, closes perpendicularly in the second movement phase. However, the gripper tip and the retaining surface of the gripper impact strip must be accurately adjusted at the beginning of the final movement phase. Additionally, to prevent abrupt movement during the opening and closing of the gripper, the two springs must be of equal strength.

OBJECTS AND SUMMARY OF THE INVENTION

It is a primary object of the present invention to improve a clamping gripper of the kind hereinbefore set out wherein a hooked gripper finger can smoothly change from an open to a closed position without any displacement or vibration resulting between the gripper tip and the retaining surface in the plane of sheet motion.

This is accomplished, according to the present invention, by a gripper having a gripper finger pivotally attached to a clamping element which is secured to a gripper shaft mounted in a recess in the press cylinder. The gripper finger is guided by a support roller disposed thereupon and spring means mounted on the clamping element bias the roller against a gripper support element. The support element includes a rectilinear guide surface disposed substantially perpendicularly to a retaining surface adjacent the cylinder periphery, and a cam surface which extends upwardly and inclined outwardly from the rectilinear guide surface. Upon oscillation of the gripper shaft, the roller is guided along the rectilinear guide surface and cam surface, thereby defining the gripper finger motion.

The primary advantage of the present invention is that the vibrations of the gripper shaft act only perpendicularly to the gripper support element, not horizontally, and consequently, the retaining surface of the support element need not be constructed of a resilient material, and the springs need not be precisely adjusted. The hooked gripper finger smoothly changes between an open and closed position, substantially without any vibrational motion in the sheet movement direction, thus ensuring no displacement of the gripper tip relative to the retaining surface.

The present invention is particularly suitable for obtaining high retaining forces between a gripper tip and gripper retaining surface, allowing the gripper to be constructed of very hard structured materials, such as titanium carbide, which are not abraded by the paper as easily as those used in known sheet grippers, and therefore, grip positively, substantially without wear and provide a long service life. Since the hooked finger is spring mounted on the clamping element rather than the gripper shaft, and since movement is accurately controlled by a cam, virtually no wear occurs at the rotating parts, bearings of the finger, or the guide surfaces of the gripper support element, and the sheet gripper is therefore easy to maintain.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a side sectional view of a sheet gripper for a sheet-fed rotary press according to the present invention showing the opening and closing movement of the hooked gripper finger;

FIG. 2 is a view similar to FIG. 1, but on a smaller scale and shows the gripper in a closed position;

FIG. 3 is a top plan view of the gripper of FIG. 2 shown in partial section, substantially as seen along the line 3—3 of FIG. 2.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, FIG. 1 shows a clamping sheet gripper in all its movement phases. The sheet gripper is secured to a gripper actuating shaft 3 by securing means 14 and is disposed in a recess 18 of a press cylinder 16 interrupting the periphery 20 thereof. The recess is formed with a generally radial outwardly opening wall 17 for supporting a gripper finger support element 4.

The sheet gripper includes a hooked gripper finger 2 pivoted on a clamping element 1, by a pivot connection 6 passing through the lower end of the longer leg of the generally inverted L-shaped finger 2. A roller 10, disposed upon the finger 2 by shaft means 5, is biased against the gripper finger support element 4 by spring means 7, shown here in the form of a compression spring. The spring means 7 also provides for the retaining force between the hooked gripper tip 9 and a gripper retaining surface 13, on the support 4 and the biasing force of the spring means 7 is preferably adjustable such as by a set screw 15.

In the inoperative region, when the gripper is closed, roller 10 is biased by the spring means 7 against a rectilinear guide surface 11 of the gripper support element 4, thus preventing horizontal displacement of the gripper tip 9 relative to the retaining surface 13. When the gripper actuating shaft 3 rotates in a counterclockwise direction, the finger 2 is initially moved upwards by pivot connection 6, perpendicularly to the retaining surface 13 of the gripper support element 4. Roller 10 then contacts a cam surface 12 of the gripper support element 4, the cam surface 12 extending upwardly and inclined outwardly from the rectilinear guide surface 11, causing the gripper finger 2 to pivot and move the tip 9 outward in front of the edge of the paper.

After the gripper actuating shaft 3 reverses and rotates in a clockwise direction, the operation continues until the gripper closes, without any operative vibrations or displacements in the plane of sheet motion. Precise adjustment of the gripper tip 9 to the retaining surface 13 of the gripper support element 4 is not needed, for example, to compensate for differences in sheet thickness or gripping area at the sheet edge.

Pursuant to another embodiment of the invention, FIGS. 2 and 3 show a gripper according to the present invention wherein additional spring means 8 is disposed between the clamping element 1 and the lower end of the longer leg of finger 2 in order to bias the lower roller 10′ against the rectilinear guide surface 11. Preferably, the spring means 8 is operative substantially along a line passing through the axes of the gripper actuating shaft 3, the pivot connection 6 and roller 10′. It will be understood that the additional spring means 8 and roller 10′ are not absolutely necessary for operating the gripper.

Since vibrations and displacements can occur only perpendicular to the plane of sheet motion, the gripper is particularly suitable for the pairing of retaining surface 13 and the gripper tip 9, surfaces which can be constructed of very hard structured material. These retaining surfaces 13, 9 are not abraded by the paper and therefore grip positively, substantially without wear, providing a long service life. Since the gripper finger 2 is biased by spring means 7 mounted on the clamping element 1 rather than being mounted directly on the gripper actuating shaft 3, and since the finger 2 movement is accurately controlled by the guide surfaces 11 and 12, substantially no wear occurs at the rotating parts, rollers 10 and 10′, the bearings of finger 2, or the guide surfaces 11 and 12 of the gripper support element 4. As a result, the sheet gripper is therefore easy to maintain and requires little service.

We claim as our invention:

1. A sheet gripper for a sheet-fed rotary press having a cylinder with a peripheral recess in which a gripper actuating shaft is disposed, said cylinder recess having an outwardly opening wall portion with a generally radially extending gripper finger support element having an outer end and an inner end secured thereto, said sheet gripper comprising, in combination, a clamping element secured to said gripper actuating shaft for oscillation therewith, a hooked gripper finger having a generally inverted L-shaped configuration which includes a longer leg and a shorter leg pivotally connected adjacent the lower end of its longer leg to said clamping element, said gripper support element having a gripper retaining surface at its outer end disposed to form an extension of the periphery of said cylinder at said recess, and having a rectilinear guide surface at its inner end disposed substantially perpendicularly to said retaining surface, said gripper support element also having a cam surface extending upwardly from said rectilinear guide surface and inclined outwardly with respect to said recess wall portion to adjacent the edge of said retaining surface, said gripper finger having a gripper tip formed adjacent its shorter L-shaped leg adapted to engage said retaining surface when said sheet gripper is closed, at least two roller elements carried by the longer leg of said gripper finger including an upper roller element disposed for engaging said rectilinear guide surface when said gripper is closed and for engaging said inclined can surface to urge said gripper tip away from said retaining surface when said gripper is opened, and a lower roller element disposed for biased engagement with said rectilinear guide surface as said gripper is opened and closed, and spring means interposed between said clamping element and said gripper finger for biasing said upper roller element and into engagement with said cam surface and said guide surface as said gripper oscillates between open to closed positions and for constantly maintaining said lower roller in biased engagement with said rectilinear guide surface.

2. A sheet gripper according to claim 1 wherein said spring means includes a compression spring interposed between said clamping element and said gripper finger and said spring is disposed substantially parallel to said inclined cam surface of said gripper support element.

3. A sheet gripper according to claim 2 wherein said clamping element includes means for adjusting the bias of said spring.

4. A sheet gripper according to claim 1 wherein said spring means includes second spring means disposed to exert its biasing force substantially along a line passing through the axes of said gripper shaft, said finger pivot connection and said lower roller element.

* * * * *